US010674780B1

(12) United States Patent
Robinson

(10) Patent No.: US 10,674,780 B1
(45) Date of Patent: Jun. 9, 2020

(54) WEAVE THREAD CUTTING KIT

(71) Applicant: Larita Robinson, Mobile, AL (US)

(72) Inventor: Larita Robinson, Mobile, AL (US)

( * ) Notice: Subject to any disclaimer, the term of this patent is extended or adjusted under 35 U.S.C. 154(b) by 0 days.

(21) Appl. No.: 16/296,538

(22) Filed: Mar. 8, 2019

(51) Int. Cl.
*A41G 5/00* (2006.01)
*D06H 7/00* (2006.01)

(52) U.S. Cl.
CPC ..... *A41G 5/0086* (2013.01); *D06H 7/00* (2013.01)

(58) Field of Classification Search
CPC ..... A41G 5/0086; D06H 7/00
USPC ..... 206/216, 223, 581; 132/201, 212–213
See application file for complete search history.

(56) References Cited

U.S. PATENT DOCUMENTS

D199,564 S * 11/1964 Koss ..... A45D 44/02 D8/98
D207,832 S 5/1967 Bridges
3,603,322 A * 9/1971 Wilson ..... A45C 11/00 132/315
D229,877 S * 1/1974 Ament ..... A41G 5/0073 D3/18
3,809,383 A * 5/1974 Ptacek ..... A45D 44/14 269/91
4,021,197 A * 5/1977 Brooks ..... A61L 2/22 132/312
4,509,538 A * 4/1985 Ramik ..... A45D 19/18 132/212
D307,820 S * 5/1990 Ullom ..... A45D 44/04 D3/20
5,010,648 A * 4/1991 Takigawa ..... B26B 21/00 30/195
5,046,620 A * 9/1991 Barabino ..... A45C 1/02 150/101
5,772,036 A * 6/1998 Muncy ..... A45C 5/005 206/581
5,819,766 A * 10/1998 Craigen ..... A45D 44/02 132/314
5,875,794 A * 3/1999 Ekman ..... A45C 5/005 132/287
5,950,826 A * 9/1999 Lykowski ..... A45C 11/008 190/102
6,062,232 A * 5/2000 Johnson ..... A45D 44/02 132/212
6,168,023 B1 * 1/2001 Cooper ..... A45D 27/22 132/290
6,241,105 B1 * 6/2001 Pomper ..... A47F 5/04 206/6.1
D649,302 S * 11/2011 Hickok ..... A45C 5/005 D30/123

(Continued)

*Primary Examiner* — Chun Hoi Cheung
*Assistant Examiner* — Brijesh V. Patel

(57) ABSTRACT

A weave thread cutting kit for weave removal includes a cutting apparatus and a stand. The cutting apparatus comprises a handle, a blade, and a cap. The blade is tapered and has a hooked end, a handle end, a sharp side, and a dull side. The handle end is coupled to a top end of the handle and the hooked end is concave relative the sharp side. The cap has an open bottom side that selectively receives the blade and selectively engages with the top end of the handle. The stand comprises a base and a post perpendicularly coupled to the base, a holder coupled to the post, and a dish coupled to the post. The holder is selectively engageable with the handle of the cutting apparatus to secure the cutting apparatus. The dish has an open top side and is configured to receive a plurality of bobby pins.

11 Claims, 4 Drawing Sheets

(56) References Cited

U.S. PATENT DOCUMENTS

| | | | | |
|---|---|---|---|---|
| 2005/0218033 | A1* | 10/2005 | Curtis | A45D 27/22 206/581 |
| 2006/0169296 | A1* | 8/2006 | Gill | A41G 5/004 132/53 |
| 2006/0219587 | A1* | 10/2006 | Redzisz | A45C 13/04 206/373 |
| 2006/0266379 | A1 | 11/2006 | Shelton | |
| 2007/0056602 | A1 | 3/2007 | Love-Johnson | |
| 2007/0125398 | A1 | 6/2007 | Johnson | |
| 2012/0073592 | A1* | 3/2012 | Koenig | A41G 5/0046 132/201 |
| 2013/0056017 | A1* | 3/2013 | Rigsby | A45D 20/12 132/271 |
| 2013/0104922 | A1* | 5/2013 | Hall | A45D 44/04 132/200 |
| 2014/0230838 | A1 | 8/2014 | Reed | |
| 2015/0007847 | A1* | 1/2015 | Nissim et al. | A41G 5/006 132/201 |
| 2016/0309882 | A1* | 10/2016 | Abramyan | A41G 5/0073 |
| 2018/0242716 | A1* | 8/2018 | Calabrese | A41G 5/0073 |
| 2019/0216208 | A1* | 7/2019 | Roberts | A45C 11/00 132/315 |

* cited by examiner

WEAVE THREAD CUTTING KIT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to weave accessories and more particularly pertains to a new weave accessory for weave removal.

BRIEF SUMMARY OF THE INVENTION

An embodiment of the disclosure meets the needs presented above by generally comprising a cutting apparatus and a stand. The cutting apparatus comprises a handle, a blade, and a cap. The handle has a top end and a bottom end. The blade is tapered and has a hooked end, a handle end, a sharp side, and a dull side. The handle end is coupled to the top end of the handle and the hooked end is concave relative the sharp side. The cap has a top side and an open bottom side. The open bottom side selectively receives the blade and selectively engages with the top end of the handle. The stand comprises a base and a post perpendicularly coupled to the base, a holder coupled to the post, and a dish coupled to the stand. The holder is selectively engageable with the handle of the cutting apparatus to secure the cutting apparatus. The dish has an open top side and is configured to receive a plurality of bobby pins.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
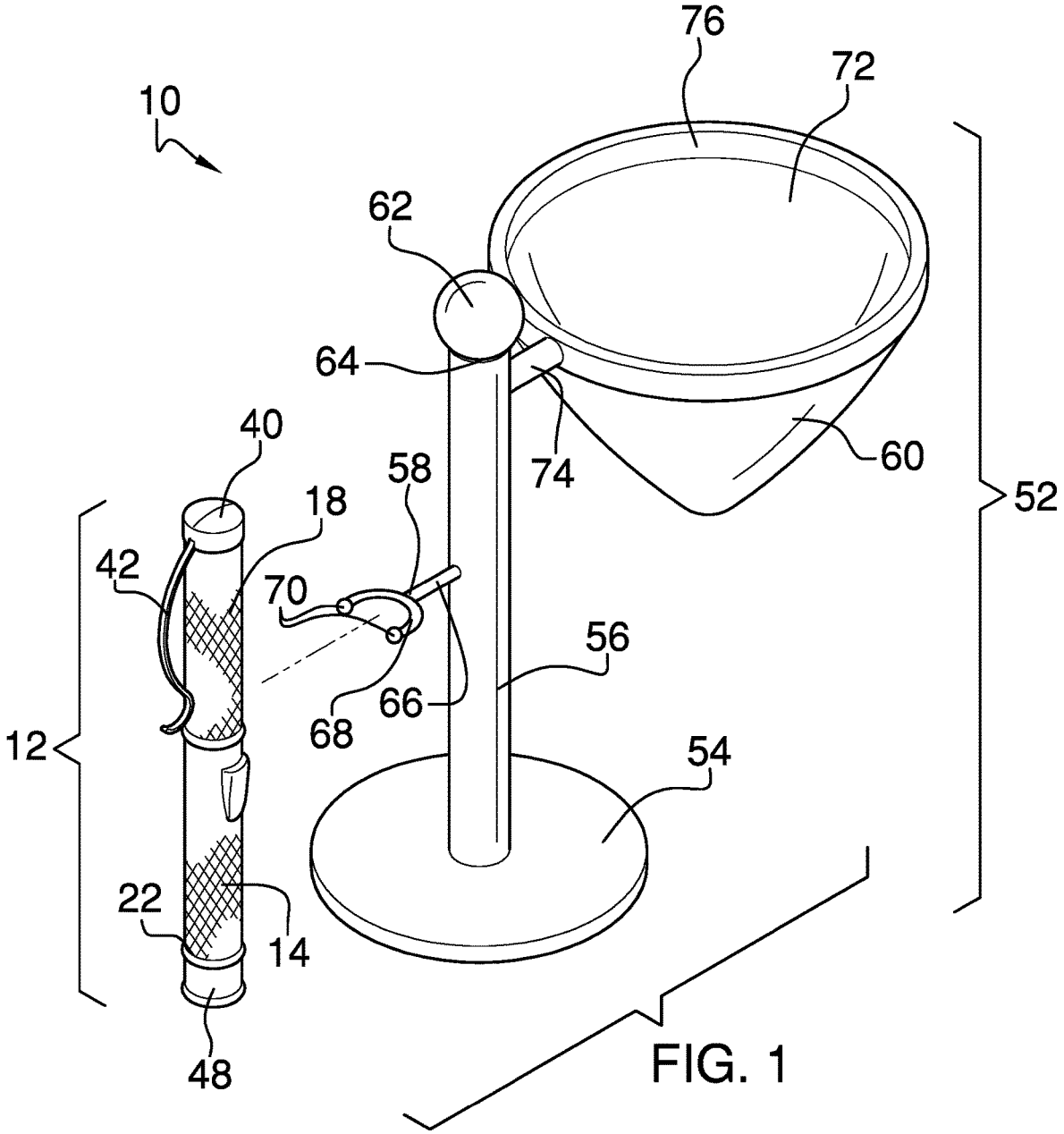
FIG. 1 is an isometric view of a weave thread cutting kit according to an embodiment of the disclosure.
Figure 2:
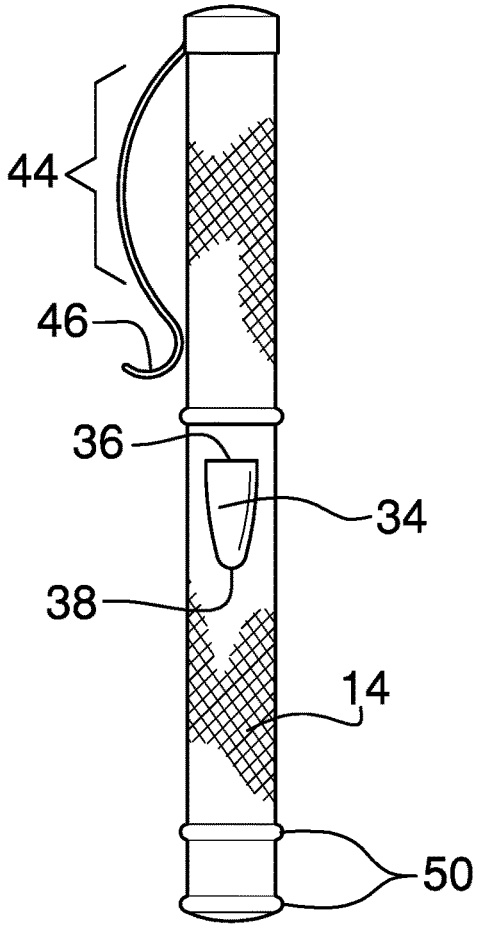
FIG. 2 is a front elevation view of an embodiment of the disclosure.
Figure 3:
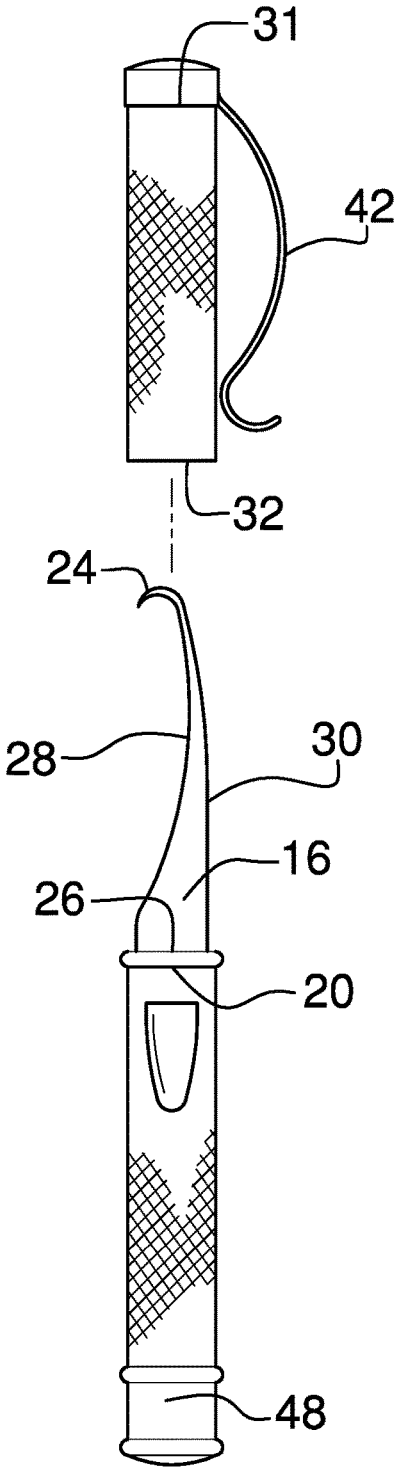
FIG. 3 is a rear elevation view of an embodiment of the disclosure.
Figure 4:
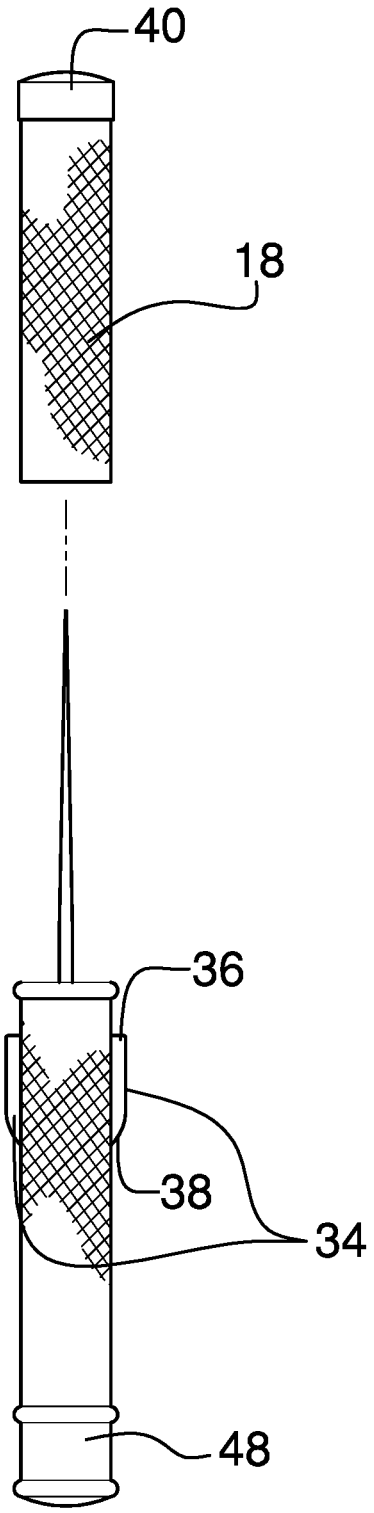
FIG. 4 is a side elevation view of an embodiment of the disclosure.
Figure 5:
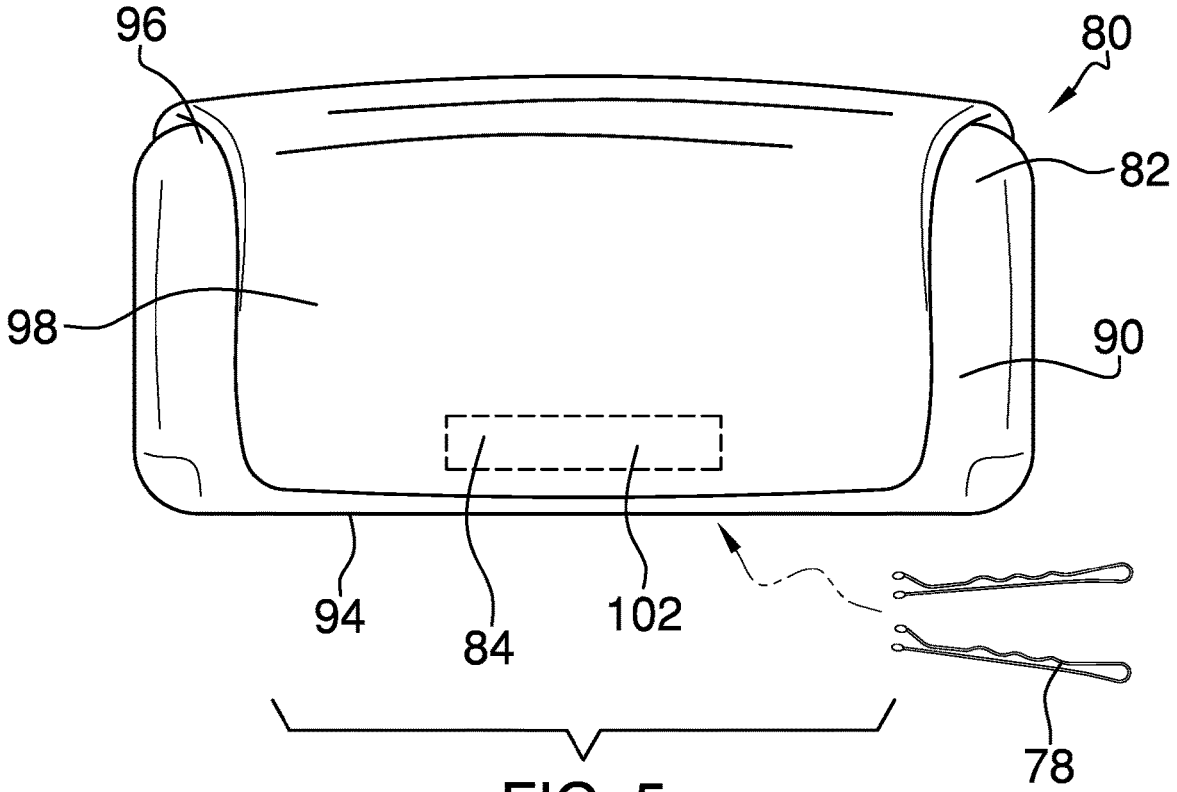
FIG. 5 is a front elevation view of an embodiment of the disclosure.
Figure 6:
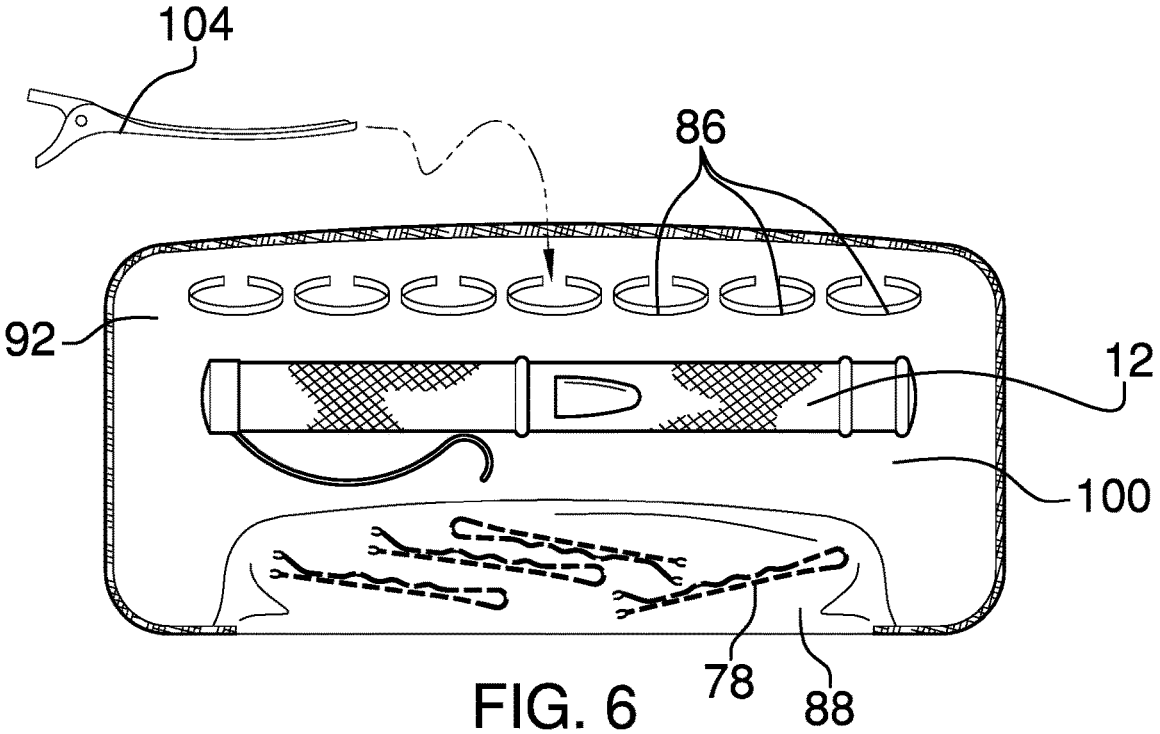
FIG. 6 is a detail view of an embodiment of the disclosure.

With reference now to the drawings, and in particular to FIGS. 1 through 6 thereof, a new weave accessory embodying the principles and concepts of an embodiment of the disclosure and generally designated by the reference numeral 10 will be described.

As best illustrated in FIGS. 1 through 6, the weave thread cutting kit 10 generally comprises a cutting apparatus 12 comprising a handle 14, a blade 16, and a cap 18. The handle 14 has a top end 20 and a bottom end 22. The blade 16 is tapered and has a hooked end 24, a handle end 26, a sharp side 28, and a dull side 30. The handle end 26 is coupled to the top end 20 of the handle and the hooked end 24 is concave relative the sharp side 28. The cap 18 has a top side 31 and an open bottom side 32. The open bottom side 32 selectively receives the blade 16 and selectively engages with the top end 20 of the handle. A pair of thumb grips 34 may be coupled to the handle 14 proximal the top end 20. Each of the pair of thumb grips 34 has a flat top 36 and a rounded bottom 38. The pair of thumb grips 34 provides a user with a place to secure the cutting apparatus 12 with his or her thumb. A top end cap 40 may be coupled to the top side 30 of the cap and may be rounded. A clip 42 may be coupled to the top end cap 40. The clip 42 has an arc portion 44 and a hooked tip 46 and may be used to secure the cutting apparatus 12 to a thin object. A bottom end cap 48 may be coupled to the bottom end 22 of the handle. The bottom end cap 48 is rounded and has a pair of ridges 50. The pair of ridges 50 provides further grip for the user's little finger.

A stand 52 comprises a base 54, a post 56, a holder 58, and a dish 60. The post 56 is perpendicularly coupled to the base 54. A finial 62 may be coupled to an upper end 64 of the post. The holder 58 is coupled to the post 56 and may comprise a rod 66 and a U-shaped end 68. The rod 66 is perpendicularly coupled to the post 56 and the U-shaped end 68 is coupled to the rod 66. The U-shaped end 68 is selectively engageable with the handle 14 of the cutting apparatus to secure the cutting apparatus 12 parallel with the post 56. The U-shaped end 68 may have a pair of ball tips 70 to more securely engage the handle 14 of the cutting apparatus. The dish 60 is coupled to the post 56 and has an open top side 72. The dish 60 may comprise an extension 74 and an upper rim 76 with the extension 74 being perpendicularly coupled to the post 56 proximal the finial 62 and the upper rim 76 being coupled to the extension 74. The open top side 72 is coupled to the upper rim 76. The dish 60 is configured to receive a plurality of bobby pins 78 and may be magnetized to secure the plurality of bobby pins 78.

The weave thread cutting kit 10 may also include a travel case 80 comprising a case body 82, a fastener 84, a plurality of clip rings 86, and a pin compartment 88. The case body 82 has a front side 90 separated from a rear side 92, a bottom side 94, and an open top side 96. The rear side 92 has a flap 98 extending past the open upper side 96 that is foldable over the open top side 96 to the front side 90 proximal the bottom side 94. The case body 82 has an inside 100 between the front side 90, the rear side 92, the bottom side 94, and the open upper side 96. The inside 100 selectively receives the cutting apparatus 12. The fastener 84 may be a hook-and-loop fastener 102 coupled to the flap 98 and to the front side 90 of the case body. The plurality of clip rings 86 is coupled within the inside 100 of the case body and is configured to receive a plurality of hair clips 104. The pin compartment 88 is coupled within the inside 100 of the case body and is configured to receive the plurality of bobby pins 78.

In use, the cutting apparatus 12 is used to cut thread that is sewn in to attach a hair weave that is applied in a protective braided style. The hooked end 24 of the blade is used to cut each thread without cutting a wearer's hair. The plurality of hair clips 104 and the plurality of bobby pins 78, which may aid in this process, are ready at hand in the dish 60 and the travel case 80.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A weave thread cutting kit, said kit comprising:

a cutting apparatus, said cutting apparatus comprising:

a handle having a top end and a bottom end;

a blade coupled to the handle, the blade being tapered and having a hooked end, a handle end, a sharp side, and a dull side, the handle end being coupled to the top end of the handle, the hooked end being concave relative the sharp side; and a cap coupled to the handle, the cap having a top side and an open bottom side, the open bottom side selectively receiving the blade and selectively engaging with the top end of the handle; and a stand, said stand comprising:

a base;

a post perpendicularly coupled to the base;

a holder coupled to the post, the holder being selectively engageable with the handle of the cutting apparatus to secure the cutting apparatus; and a dish coupled to the post, the dish having an open top side, the dish being configured to receive a plurality of bobby pins.

2. The weave thread cutting kit of claim 1 further comprising the cutting apparatus having a pair of thumb grips, the pair of thumb grips being coupled to the handle proximal the top end, each of the pair of thumb grips having a flat top and a rounded bottom.

3. The weave thread cutting kit of claim 1 further comprising a top end cap and a bottom end cap coupled to the cutting apparatus, the top end cap being coupled to the top side of the cap, the bottom end cap being coupled to the bottom end of the handle.

4. The weave thread cutting kit of claim 3 further comprising a clip coupled to the top end cap, the clip having an arc portion and a hooked tip.

5. The weave thread cutting kit of claim 3 further comprising each of the top end cap and the bottom end cap being rounded and the bottom end cap having a pair of ridges.

6. The weave thread cutting kit of claim 1 further comprising the stand having a finial, the finial being coupled to an upper end of the post.

7. The weave thread cutting kit of claim 1 further comprising the holder comprising a rod and a U-shaped end, the rod being perpendicularly coupled to the post and the U-shaped end being coupled to the rod, the U-shaped end having a pair of ball tips.

8. The weave thread cutting kit of claim 6 further comprising the dish comprising an extension and an upper rim, the extension being perpendicularly coupled to the post proximal the finial and the upper rim being coupled to the extension.

9. The weave thread cutting kit of claim 8 further comprising the dish being magnetized.

10. The weave thread cutting kit of claim 1 further comprising a travel case, said travel case comprising:

a case body, said case body having a front side separated from a rear side, a bottom side, and an open upper side, the rear side having a flap extending past the open upper side, the flap being foldable over the open top side to the front side proximal the bottom side, the case body having an inside between the front side, the rear side, the bottom side, and the open top side, the inside selectively receiving the cutting apparatus;

a hook-and-loop fastener coupled to the case body, the hook-and-loop fastener being coupled to the flap and to the front side of the case body;

a plurality of clip rings coupled to the case body, the plurality of clip rings being coupled within the inside of the case body, the plurality of clip rings being configured to receive a plurality of hair clips; and a pin compartment coupled to the case body, the pin compartment being coupled within the inside of the case body, the pin compartment being configured to receive the plurality of bobby pins.

11. A weave thread cutting kit, said kit comprising:

a cutting apparatus, said cutting apparatus comprising:

a handle having a top end and a bottom end;

a blade coupled to the handle, the blade being tapered and having a hooked end, a handle end, a sharp side, and a dull side, the handle end being coupled to the top end of the handle, the hooked end being concave relative the sharp side;

a pair of thumb grips, the pair of thumb grips being coupled to the handle proximal the top end, each of the pair of thumb grips having a flat top and a rounded bottom;

a cap coupled to the handle, the cap having a top side and an open bottom side, the open bottom side selectively receiving the blade and selectively engaging with the top end of the handle;

a top end cap coupled to the top side of the cap, the top end cap being rounded;

a clip coupled to the top end cap, the clip having an arc portion and a hooked tip;

a bottom end cap being coupled to the bottom end of the handle, the bottom end cap being rounded and having a pair of ridges;

a stand, said stand comprising:

a base;

a post perpendicularly coupled to the base, the post having an upper end;

a finial coupled to the post, the finial being coupled to the upper end of the post;

a holder coupled to the post, the holder comprising a rod and a U-shaped end, the rod being perpendicularly coupled to the post and the U-shaped end being coupled to the rod, the U-shaped end having a pair of ball tips, the U-shaped end being selectively engageable with the handle of the cutting apparatus to secure the cutting apparatus;

a dish coupled to the post, the dish having an open top side, the dish comprising an extension and an upper rim, the extension being perpendicularly coupled to the post proximal the finial and the upper rim being coupled to the extension, the open top side being coupled to the upper rim, the dish being configured to receive a plurality of bobby pins, the dish being magnetized; and a travel case, said travel case comprising:

a case body, said case body having a front side separated from a rear side, a bottom side, and an open upper side, the rear side having a flap extending past the open upper side, the flap being foldable over the open top side to the front side proximal the bottom side, the case body having an inside between the front side, the rear side, the bottom side, and the open top side, the inside selectively receiving the cutting apparatus;

a hook-and-loop fastener coupled to the case body, the hook-and-loop fastener being coupled to the flap and to the front side of the case body;

a plurality of clip rings coupled to the case body, the plurality of clip rings being coupled within the inside of the case body, the plurality of clip rings being configured to receive a plurality of hair clips; and a pin compartment coupled to the case body, the pin compartment being coupled within the inside of the case body, the pin compartment being configured to receive the plurality of bobby pins.

* * * * *